US007006052B2

(12) United States Patent
Delgado et al.

(10) Patent No.: US 7,006,052 B2
(45) Date of Patent: Feb. 28, 2006

(54) PASSIVE MAGNETIC RADOME

(75) Inventors: Heriberto Jose Delgado, Melbourne, FL (US); William D. Killen, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 26 days.

(21) Appl. No.: 10/439,094

(22) Filed: May 15, 2003

(65) Prior Publication Data

US 2004/0227687 A1 Nov. 18, 2004

(51) Int. Cl.
*H01Q 1/42* (2006.01)

(52) U.S. Cl. ..... 343/872; 343/873

(58) Field of Classification Search ..... 343/872, 343/873, 909, 753; H01Q 1/42
See application file for complete search history.

(56) References Cited

U.S. PATENT DOCUMENTS

| | | | | |
|---|---|---|---|---|
| 3,581,243 A | | 5/1971 | Alford | |
| 3,681,716 A | | 8/1972 | Chiron et al. | |
| 4,638,271 A | | 1/1987 | Jecko et al. | |
| 4,967,171 A | | 10/1990 | Ban et al. | |
| 5,017,939 A | * | 5/1991 | Wu | 343/911 R |
| 5,344,685 A | * | 9/1994 | Cassell | 428/64.1 |
| 5,400,043 A | * | 3/1995 | Arceneaux et al. | 343/872 |
| 5,600,325 A | | 2/1997 | Whelan et al. | |
| 5,652,631 A | * | 7/1997 | Bullen et al. | 343/872 |
| 5,714,112 A | | 2/1998 | Hazeyama et al. | |
| 5,724,052 A | | 3/1998 | Boulingre et al. | |
| 6,139,943 A | * | 10/2000 | Long et al. | 428/304.4 |
| 6,157,349 A | * | 12/2000 | Crouch | 343/872 |
| 6,424,308 B1 | | 7/2002 | Wu et al. | |
| 6,452,564 B1 | * | 9/2002 | Schoen et al. | 343/872 |
| 6,788,273 B1 | * | 9/2004 | Schultz et al. | 343/909 |

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/448,973, filed May 30, 2003, Delgado et al.
U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.

(Continued)

*Primary Examiner*—Hoanganh Le
(74) *Attorney, Agent, or Firm*—Sacco & Associates, PA

(57) ABSTRACT

A radome (202) includes a dome wall (208) formed from a dielectric material wherein at least a portion of the dielectric material includes a plurality of magnetic particles (206). Radomes according to the invention can form dome walls of variable thickness, yet still have high radiation efficiency across a wide frequency band. Magnetic radomes utilize dielectrics including magnetic particles (206) to match the impedances between medium boundaries, such as an air to dome boundary.

14 Claims, 7 Drawing Sheets

OTHER PUBLICATIONS

U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/308,500, filed Dec. 3, 2002, Killen et al.
U.S. Appl. No. 10/373,935, filed Feb. 25, 2003, Killen et al.
U.S. Appl. No. 10/404,285, filed Mar. 31, 2003, Killen et al.
U.S. Appl. No. 10/404,981, filed Mar. 31, 2003, Killen et al.
U.S. Appl. No. 10/404,960, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpf, Jr., et al.
U.S. Appl. No. 10/185,824, filed Jun. 27, 2002, Killen et al.
U.S. Appl. No. 10/185,187, filed Jun. 27, 2002, Killen et al.
U.S. Appl. No. 10/185,855, filed Jun. 27, 2002, Killen et al.
U.S. Appl. No. 10/185,459, filed Jun. 27, 2002, Killen et al.
U.S. Appl. No. 10/185,480, filed Jun. 27, 2002, Killen et al.
Itoh, T.; et al: "Metamaterials Structures, Phenomena and Applications" IEEE Transactions on Microwave Theory and Techniques: Apr., 2005; Online Retrieved from the Internet: URL.www.mtt.org/publications/Transactions/ CFP_Metamaterials, pdf>.
Kiziltas, G.; et al: "Metamaterial design via the density method" IEEE Antennas and Propagation Society Int'l Symposium 2002, vol. 1, Jun. 16, 2002 pp 748-751, Piscataway.
Salahun, E.; et al: "Ferromagnetic composite-based and magnetically-tunable microwave devices" IEEE MTT-S Microwave Symposium Digest, vol. 2, Jun. 2, 2002 pp1185-1188.

* cited by examiner

600

700

PASSIVE MAGNETIC RADOME

BACKGROUND OF THE INVENTION

1. Statement of the Technical Field

The present invention relates to the field of radomes, and more particularly to low loss broadband radomes.

2. Description Of The Related Art

Radomes are dome-like shells that are substantially transparent to radio frequency radiation. Functionally, radomes can be used to protect enclosed electromagnetic devices, such as antennas, from environmental conditions such as wind, solar loading, ice, and snow. Conventional radome types include sandwich, space frame, solid laminate, and air supported.

Radomes can sometimes form very large domes for protecting large electromagnetic devices. For example, a space frame radome installed at Mt. Hebo in 1966 as part of the ballistic missile early warning system, had a diameter of 140 feet. Manufacturing and transportation considerations necessitate that large radomes be constructed in segments, often referred to as panels. One technique for connecting adjacent panels is to construct a rigid domne-supporting frame and subsequently attach a plurality of panels to the frame. Alternately, interlocking radome panels can form a self-supporting shell with adjacent panels connected through some connective mechanism, such as a flange.

Sandwich radomes are rigid, self-supporting structures constructed of numerous doubly curved panels that, after assembly, form a spherical dome. Panels are partially composed of tight tolerance controlled dielectric materials, such as pre-impregnated fiberglass. When panels contain multiple layers of such dielectric materials, foams can be utilized between the layers to maintain spatial relationships. For example, a CFC-free, closed cell, polyisocyanurate foam is often used between dielectric layers. While the frame formed at panel junctions can provide support between adjacent panels, the panels themselves are the primary support infrastructure for the radome. Notably, the panel segments of a sandwich radome are randomly oriented to significantly reduce the boresight error and sidelobe perturbations that can form at panel junctions.

Another radome type is a space frame radome. A space frame radome is a rigid, self-supporting structure containing a load bearing frame and wall members supported by the frame. The frame is composed of triangular panels assembled into a geodesic dome using quasi-random geometric placement to optimize electromagnetic performance. Notably, the losses caused by a radome frame, often referred to as scatter loss, can be several times greater than a wall insertion loss of the radome, which signifies the loss caused by reflections occurring at the panel/air boundary. The wall of a space frame radome can be a thin electromagnetically transmissive membrane material, such as ESSCOLAM®. Typical materials for forming the frame of a space frame radome can include dielectrics, such as fiberglass, and metals, such as aluminum and steel.

When metals are used in the frame construction, electromagnetic waves striking the frame are always reflected. Dielectrics, such as fiberglass, which reflect partially electromagnetic radiation, can be beneficially utilized in the frame formation. Unfortunately, dielectric frames have numerous drawbacks. Structural characteristics of dielectric materials require a substantially greater cross sectional area than equivalent metallic counterparts in order to provide equivalent mechanical support. Furthermore, the width of conventional dielectric materials affect the wave transmissions as can be shown using transmission line analysis techniques. Accordingly, radio frequency wave perturbations can sometimes be greater when using a dielectric frame than the equivalent perturbations resulting from a metallic frame.

Solid laminate radomes are rigid, self-supporting structures that use doubly curved panels to form a truncated spherical dome. The panels of a solid laminate radome can be constructed from pre-impregnated fiberglass and are generally arranged in a regular or "orange peel" geometry. Solid laminate designs can be cost effective for smaller radomes, but are generally unsuitable for larger ones.

A fourth type of radome, an air supported radome, is not generally utilized outside tactical applications or temporary installations. The air supported radome is an active system consisting of a thin fabric envelope and a system comprising a power supply and blowers. The fabric envelope is formed from a flexible dielectric material. The blowers keep the outer fabric envelope inflated in a balloon-like fashion. Because an air frame radome must be inflated at all times, reliable operation generally depends upon non-interruptible power supplies and redundant blower systems.

Radome induced wave perturbations are a principal consideration in radome construction. An ideal radome is electromagnetically transparent to a large number of radio frequencies, through a wide range of incident angles. However, in practice, conventional radomes are inherently lossy and are narrowbanded. Moreover, loss generally increases with angle of incidence. Radomes are generally designed to have a lower loss at a specific angle of incidence and a larger loss at the remaining angles. Often, the angle at normal incidence is chosen as the angle of lower loss in a radome design.

Traditionally, the RF loss in radomes is minimized by adjusting the phase factor of the radome at a single radio frequency. For instance, the thickness of a dielectric radome having a given permittivity can be a multiple of half a wavelength at a given frequency. When so formed, a very small reflection coefficient will result at that frequency. Unfortunately, such a radome transmits electromagnetic waves with minimal loss only over a narrow frequency band about a center frequency. In order to overcome this limitation, some radomes are made of several layers of dielectric slabs, so that a broader group of frequencies can be transmitted with low loss.

In addition, the walls of conventional radomes are formed from dielectric materials which provide a relative magnetic permeability of nearly one. In fact, conventional teachings suggest that metals, including magnetic metals, within radomes, are to be avoided unless required by overriding structural considerations. The reason why magnetic materials have been avoided in the past, in the fabrication of radomes, is the inherent large value of the magnetic loss tangent. The magnetic loss tangent is the driving material property used in the fabrication of microwave absorbers. However, when the magnetic loss tangent is reduced to acceptably low levels, of the order of 0.1 or lower, the relative permeability can be used to reduce the transmission loss by matching the intrinsic impedances of the mediums involved in the wave transmission and reflection phenomenons.

SUMMARY OF THE INVENTION

The invention disclosed herein provides a method for constructing low loss broadband radomes which include walls having magnetic particles therein. Prior to the invention, dielectrics used for forming the walls of radomes have been nonmagnetic. By utilizing magnetic particles within the radome wall, an intrinsic impedance match and a resulting low loss operation can be established across a broad band of frequencies., Such an intrinsic impedance match requires the relative permeability value of the radome wall to be adjusted based upon the relative permittivity value of the wall and the relative permeability and permittivity values of the environment surrounding the radome. The intrinsic impedance match for a wave is dependant upon an angle of incidence at which the wave strikes the radome wall. Specifically, when the environment is air, an intrinsic impedance match can be established for a wave at normal incidence when the relative permeability and permittivity values of the wall are about equal. Calculations based upon the angle of incidence, the angle of transmittal, and the relative permeability and permittivity values for the wall and the environment can minimize the reflections occurring at any particular angle of incidence.

One aspect of the present invention can include a radome. The radome can include a dome wall, wherein the dome wall can be formed from at least one dielectric material. At least a portion of the dielectric material can include magnetic particles. In one embodiment, at least a portion of the dome wall can have a relative magnetic permeability of at least 1.1. In another embodiment, at least a portion of the dome wall can include a composite material including multiple fibers. These fibers can be interlaced to form a lattice that can be polarization sensitive. In yet another embodiment, the dome wall can allow selective transmission of waves based on particular polarities. The selective transmissions can be determined by a selection and placement of at least a portion of the magnetic particles within the dielectric material. In a particular embodiment, the dielectric material can include at least one metamaterial. In another embodiment, the invention can include a radome frame where at least a portion of the radome frame can be formed from at least one dielectric material frame. At least a portion of the dielectric material frame can include magnetic particles.

In one embodiment, $\mu_1$ can be the relative magnetic permeability of the dielectric material of the radome and $\in_1$ can be the relative electric permittivity of the dielectric material. Furthermore, $\mu_2$ can be the relative permeability of a medium forming a boundary between the medium and the dome and $\in_2$ can be the relative permittivity of the medium. Moreover, $\theta_1$(can be the angle of incidence of a wave striking the boundary between the medium and the dome. Additionally, $\theta_t$ can be the angle of transmission of the wave. In a further embodiment, at least one dielectric material can include a first dielectric layer and at least one supplemental dielectric layer. The relative permeability and relative permittivity of the first dielectric layer can be $\mu_3$ and $\in_3$, respectively and the relative permeability and relative permittivity of the supplemental dielectric layer can be $\mu_4$ and $\in_4$, respectively. The selection of the dielectric material can be based upon any or all of the values of $\mu_1$, $\in_1$, $\mu_2$, $\in_2$, $\theta_i$, $\theta_t$, $\mu_3$, $\in_3$, $\mu_4$, and/or $\in_4$. Any or all of these values can be based upon a concentration or placement of the magnetic particles within the dielectric materials.

In a further embodiment, the wave can be a perpendicularly polarized plane wave and $\mu_1$ can be between $0.95*(\in_1*\mu_2/\in_2)*(\cos\theta_i/\cos\theta_t)^2$ and $1.05*(\in_1*\mu_2/\in_2)*(\cos\theta_i/\cos\theta_t)^2$. When the wave is a parallel polarized plane wave, $\mu_1$ can be between $0.95*(\in_1*\mu_2/\in_2)*(\cos\theta_t/\cos\theta_i)^2$ and $1.05*(\in_1*\mu_2/\in_2)*(\cos\theta_t/\cos\theta_i)^2$. Additionally, $\mu_3$ can be between $0.95*((\in_3*\mu_4)/\in_4)$ and $1.05*(\in_3*\mu_4/\in_4)$.

In engineering applications, permeability is often expressed in relative, rather than in absolute, terms. If $\mu o$ represents the permeability of free space (that is, $1.257\times10^{-6}$ H/m) and $\mu$ represents the permeability of the material in question, then the relative permeability, $\mu r$, is given by: $\mu r=\mu/\mu o=\mu(7.958\times10^5)$.

Accordingly, magnetic materials are materials having a relative permeability $\mu r$ that is either greater than 1, or less than 1. Magnetic materials are commonly classified into the three groups described below.

Diamagnetic materials are materials which provide a relative permeability of less than one, but typically from 0.99900 to 0.99999. For example, bismuth, lead, antimony, copper, zinc, mercury, gold, and silver are known diamagnetic materials. Accordingly, when subjected to a magnetic field, these materials produce a slight decrease in magnetic flux, due to the negative value of the magnetic susceptibility, as compared to a vacuum.

Paramagnetic materials are materials which provide a relative permeability of greater than one and up to about 10. Paramagnetic materials include materials such as aluminum, platinum, manganese, and chromium. Paramagnetic materials generally lose their magnetic properties immediately after an external magnetic field is removed.

Ferromagnetic materials are materials which provide a relative permeability greater than 10. Ferromagnetic materials include a variety of ferrites, iron, steel, nickel, cobalt, and commercial alloys, such as alnico and peralloy. Ferrites, for example, are made of ceramic material and have relative permeabilities that range from about 50 to 200.

As used herein, the term "magnetic particles" refers to particles when intermixed with dielectric materials, result in a relative permeability $\mu r$ that is greater than 1 for the resulting dielectric material. Accordingly, ferromagnetic and paramagnetic materials are generally included in this definition, while diamagnetic particles are generally not included. The relative permeability $\mu r$ can be provided in a large range depending on the intended application, such as 2, 3, 4, 6, 8, 10, 20, 30, 40, 50, 60, 80, 100, or higher, or values in between these values.

BRIEF DESCRIPTION OF THE DRAWINGS

There are shown in the drawings embodiments, which are presently preferred, it being understood, however, that the invention is not limited to the precise arrangements and instrumentalities shown.

DETAILED DESCRIPTION OF THE PREFERRED EMBODIMENTS

The invention disclosed herein provides a low loss broadband radome that includes walls having a relative permeability lur greater than one and methods for forming the same. Materials used in the construction of conventional radomes vary depending on the radome type. Conventional radomes provide dome walls made of dielectric materials having relative permeability $\mu r$ of nearly 1.

Figure 1:
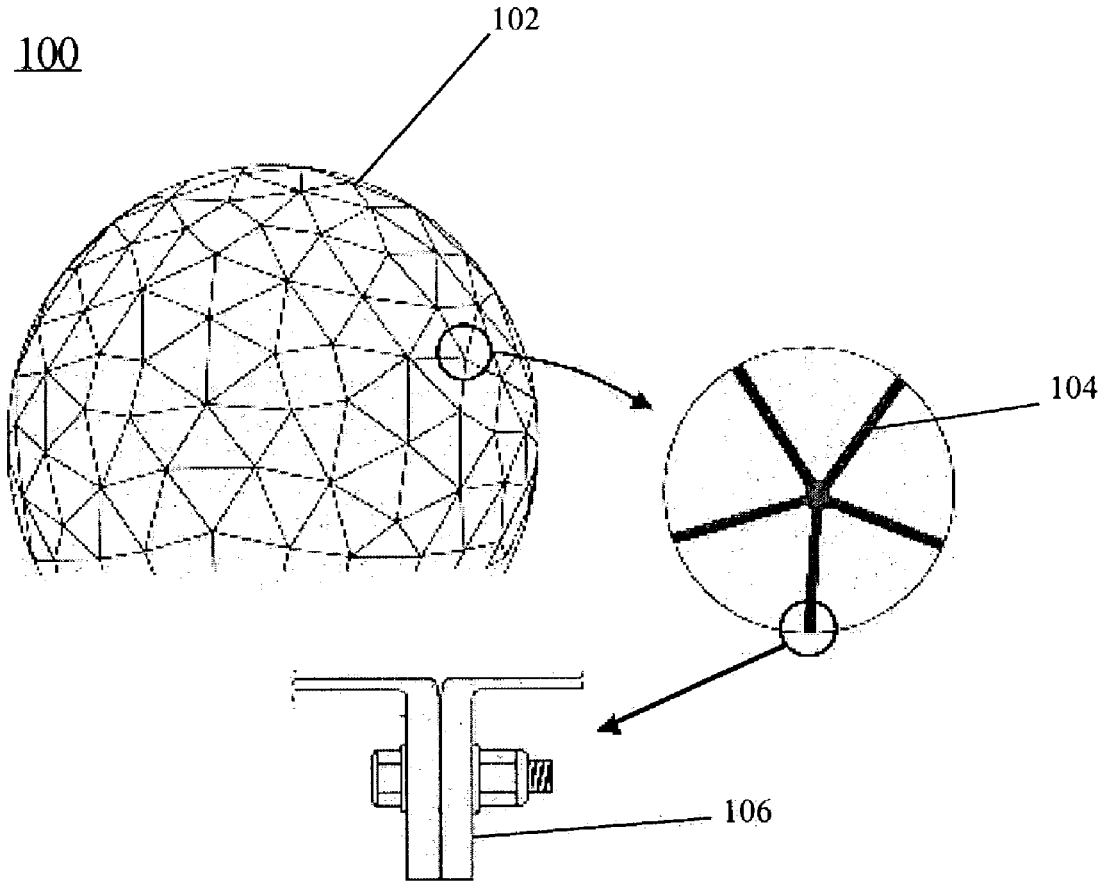
FIG. 1 PRIOR ART
FIG. 1 is a schematic diagram illustrating a conventional space frame radome.

FIG. 1 is a schematic diagram illustrating a system 100 including a prior art space frame radome. System 100 illustrates a space frame radome 102, a magnified view of a radome frame 104, and a side view of a panel flange 106 used to connect adjacent frame panels.

In its simplest form, a space frame radome 102 utilizes a triangular patterned frame covered by a thin membrane material (not shown) forming one dome wall. The material forming the radome frame 104 can be aluminum, steel, or a dielectric, such as fiberglass. When a dielectric material is used to form a radome frame 104, inductive circuit elements, such as wire and metallic strips, can be laminated to the dielectric panel flange 106 framework to minimize perturbations caused by the radome frame 104.

The dome wall of a radome can be formed from a plurality of interlocking panels. Each panel can include an outer membrane, an interior foam placed between panel membrane layers, and an exterior environmental coating. Membranes are often rigid panel layers and are generally thin dielectric materials with accompanying low electric loss tangents. For example, pre-tensioned polyester laminates are commonly used as membrane materials. A radome wall can include several membrane layers. The relative permeability or of conventional membrane materials is nearly 1.

Foams formed from dielectric materials are sometimes used within dome walls to fill gaps between membrane layers. As with conventional dielectric substrates, available foams have uniform dielectric properties. The relative permittivity of commonly available foams range from 2 to 4. The relative permeability pr of these foam materials is near 1.

An exterior coating, usually a hydrophobic material, can be applied to the exterior of a radome to reduce rain adherence to the outer radome surface. Adherence can cause power absorption and the increase of the noise temperature. The use of hydrophobic materials significantly reduces rain adherence and the accompanying power loss, additive noise-temperature and ice adhesion which can otherwise result. For example, Tedlar®, Gelcoat, and Hydrolam 1000® are all hydrophobic coatings used on exterior radome surfaces. The relative permeability of all three of these three materials is nearly 1.

Figure 2:
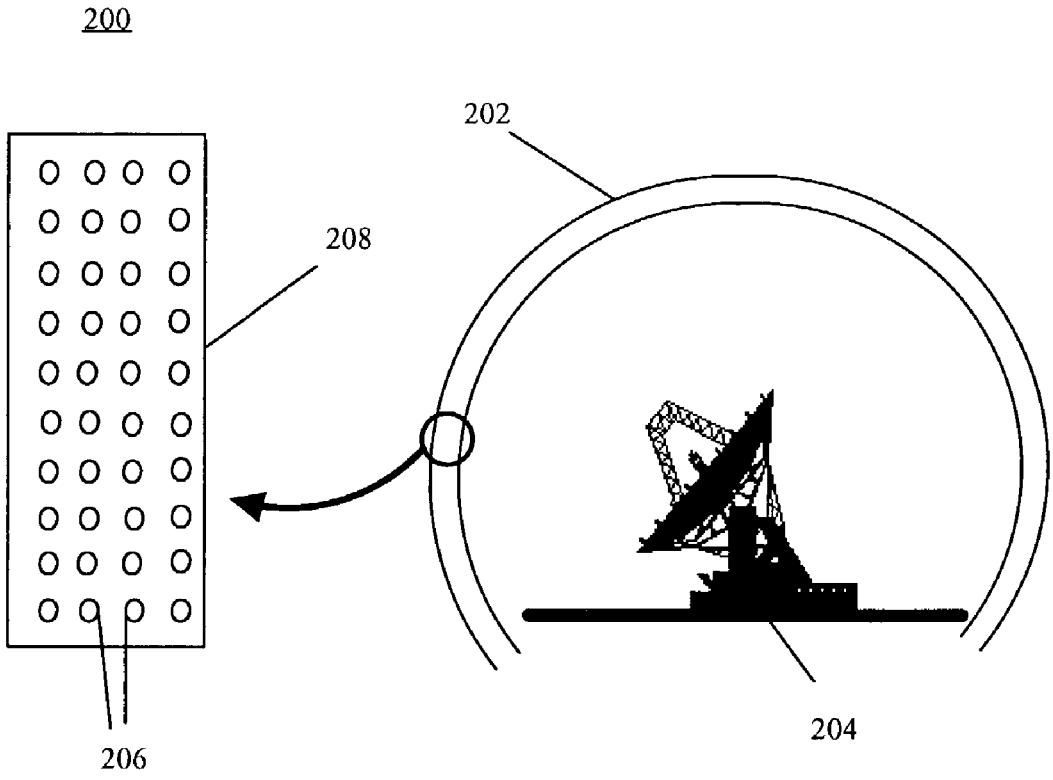
FIG. 2 is a schematic diagram illustrating a radome that includes magnetic particles, according to an embodiment of the invention.

FIG. 2 is a schematic diagram of a system 200 including a magnetic radome in accordance with an embodiment of the invention. As shown in FIG. 2, system 200 can include a radome 202, an antenna 204, as well as a magnified view showing a dome wall 208 which includes magnetic particles 206. Although radome 202 is shown as a rigid structure, the invention can be utilized with non-rigid structures, such as air-supported radomes. Similarly, the invention is not limited to a particular antenna 204 type, but can be used with any type of antenna.

The cross sectional view of radome 202 depicts the inclusion of magnetic particles 206 within a dielectric material used to form the dome wall 208. The magnet particles 206 can be uniformly distributed within the dome wall 208, or can be otherwise dispersed (e.g. randomly distributed). Magnetic particles 206 can be metamaterial particles, which can be inserted into voids created in the dome wall 208, as discussed in detail later. The ability to include magnetic particles 206 in the dome wall 208 to achieve significant increases in the magnetic permeability permits improved impedance matching between the dome wall 208 and the environment (e.g. air). The introduction of magnetic particles increases the magnetic loss tangent. Therefore, the magnetic loss tangent must be minimized. Consequently, the selection and placement of the magnetic particles in the compound mixture must be done with a specified degree of accuracy. As used herein, a significant magnetic permeability refers to a relative magnetic permeability of at least about 1.1.

Additionally, magnetic particles 206 can be embedded in the radome so as to form an isotropic or an anisotropic medium. Notably, when the magnetic particles 206 embedded in the dome wall 208 are isotropic, the radome 202 becomes increasingly insensitive to polarization. If anisotropic materials are used, the electrical and magnetic properties of the dome wall 208 will differ across orientation planes x, y, or z. Thus, anisotropic magnetic materials included within dome wall 208 can permit only selected polarizations to be transmitted.

The voids in the substrate must be made so as to be elongated rectangular cavities in the desired planes, which can be oriented in the x, the y or the z directions, or in a direction in between, not necessarily in a straight line. Then, a compound material, referred to as a magnetic compound, is formed by adding the appropriate amount of magnetic particles to a dielectric material. In the formation of the magnetic material, external electric or magnetic fields can be used to obtain the desired material properties. A property of ferroelectric and ferromagnetic materials, called the hysteresis loop, which is a double valued curve, is used when external electric and magnetic fields are applied. Electric materials with a hysteresis loop property are called ferroelectric materials. Magnetic materials, or magnetic particles, with a hysteresis loop property are called ferromagnetic materials. In ferroelectric materials, the hysteresis loop is a double valued curve of the electric field intensity E versus the electric field flux density D. Hence, in ferroelectric materials, the relationship of the applied electric field E and the relative permittivity is non-linear. Therefore, an external electric field can be applied so that the relative permittivity is adjusted.

When the external electric field is removed, the new dielectric constant will remain unchanged given that the hysteresis loop crosses the y-axis at a non-zero electric field intensity E value, where the applied electric field intensity E corresponds to the x-axis. Barium titanate is the most widely used ferroelectric compound. In ferromagnetic materials and ferrites, the hysteresis loop is a double valued curve of the magnetic field intensity H versus the magnetic field flux density B. Hence, in ferromagnetic materials, the relationship of the applied magnetic field H and the relative permeability is non-linear. Therefore, an external magnetic field can be applied so that the relative permeability is adjusted. When the external magnetic field is removed, the new permeability remains nearly unchanged given that the hysteresis loop crosses the axis at a non-zero magnetic field intensity H value, where the applied magnetic field intensity H corresponds to the x-axis. Examples of ferromagnetic materials include Cobalt, Iron, Nickel and Mumetal. Ferrites are a class of solid ceramic materials with crystal structures formed by sintering at high temperatures stoichiometric mixtures of certain oxides. Then, the voids in the substrate can be filled with the completed magnetic material. The voids at different planes can be filled with different magnetic materials. The magnetic loss tangent and the electric loss tangent of the magnetic material can also be minimized by the suitable choice of the magnetic particles, the dielectric substrate, and the three-dimensional spatial lattice structure of the magnetic particles.

In addition to acting as a protective environmental shell, radome 202 can function as a lens. When electromagnetic waves cross medium boundaries, such as dome wall 208, both reflections and refractions (or transmissions) occur. Refraction or transmission is a deflection from a straight path undergone by an electromagnetic wave in passing from one medium to another at an oblique angle. Additionally, a lens is a device that utilizes refraction or transmission to focus electromagnetic waves in a configurable manner dependant upon lens properties and positioning.

One of ordinary skill in the art can appreciate that the amount of deflection caused by a lens depends upon an angle of incidence of a specified wave and the indexes of refraction of the mediums involved. In the case of radome 202, relevant parameters include an index of refraction for an environment surrounding radome 202, an index of refraction for the dome wall 208, and an angle of incidence of this non-normal radio frequency wave. Since the radio frequency wave can be transmitted across a dome wall, radome 202 can, by definition, function as a radio frequency lens.

Traditional lenses, such as optical lenses used in eyeglasses, are curved in a convex or concave manner. This curvature alters the angle of incidence at which waves strike a lens surface deflecting the light waves in some manner, often focusing the light waves at a particular point. An alternative way to focus electromagnetic waves, including light waves, is to alter the intrinsic properties of the lens at the appropriate frequency, hence changing the properties of the medium through which electromagnetic radiation passes. The index of refraction is frequency dependent; and therefore, the index of refraction is different for light waves and electromagnetic waves traveling at a lower frequency in a given medium.

A typical example is water, where the index of refraction is 9 at 1 MHz; and the index of refraction at visible frequency ranges (light), such as such as $2\times10^9$ MHz, is 1.33. The extreme transparency of water has its origins in the basic energy level structure of the atoms and molecules. Traditionally, altering medium properties to deflect electromagnetic waves has not been widely used due to limitations of the physical properties of naturally occurring materials. Namely, naturally occurring materials are not designed to meet specific performance criteria.

The index of refraction is positive for the material components used in the design of metamaterials. The direction of the refracted waves can be selected by the appropriate design of the metamaterial. In this way, the equivalent mathematical index of refraction of the composite metamaterial can be positive or negative. Such a phenomenon can be achieved using known techniques in the field of frequency selective surfaces. The positive index of refraction of each material component results from the fact that the permittivity and the permeability are always positive for the material components presented.

The metamaterial components can be dielectric substrates, magnetic particles, ferroelectric materials, ferromagnetic materials, ferrites, etc. The behavior of the metamaterial, which is a composite structure, is determined by the full wave solution of the electromagnetic fields inside and outside the material using Maxwell equations. In this application, the manipulation of the permeability to achieve lossless broadband radomes is the focus of the present discussion. Changing the permeabilit of a medium will also change the index of refraction. Therefore, a material through which the majority of the electromagnetic energy is transmitted will cause bending of the electromagnetic wave as it travels across the boundaries when the index of refraction is different from one.

The behavior of the composite structure, or metamaterial, results from the electromagnetic interaction of material components with positive permittivity and permeability values. The electromagnetic interaction can be in the form of electromagnetic coupling between voids, surface currents, coupling between magnetic particles and the walls of the voids, and other physical phenomenons which can produce controlled and uncontrolled radiation as the result of the said electromagnetic interactions. The design of the metamaterial crystal lattice can provide a greater degree of control of the reflected and refracted or transmitted fields. Such physical processes are very similar to the physical processes found in frequency selective surfaces, except that the metamaterial can have resonant and non-resonant array metallic elements placed in a three-dimensional lattice, and the material properties can be changed at localized portions of the material.

When the metamaterial is formed by using the appropriate material components, in a chosen crystal lattice, the angle of transmission for the electromagnetic wave can be selected, without adjusting the angle of incidence. In the invention, such adjustments can be accomplished by providing magnetic particles 206 within dome wall 208 and altering the placement and selection of these magnetic particles 206. Such adjustments are well within the ordinary skill of a metamaterial manufacturer, as detailed later. Hence, because the invention can utilize metamaterials within the dome wall 208, a magnetic radome 202 can function as a highly configurable radio frequency lens.

As defined herein, the term "metamaterials" refers to composite materials formed from the mixing or arrangement of two or more different materials at a very fine level, such as the angstrom or nanometer level. Metamaterials allow tailoring of electromagnetic properties of the composite, which can be defined by effective electromagnetic parameters comprising effective electrical permittivity $\in_{eff}$ (or dielectric constant) and the effective magnetic permeability $\mu_{eff}$.

Although dome wall 208 depicted in system 200 illustrates a single layer construction, the invention can use more than one layer. The layered dome wall 208 can consist of magnetic and non-magnetic dielectric materials. In one embodiment, dome wall 208 can include one or more magnetic dielectric layers and one or more non-magnetic dielectric layers formed from such materials as foams, hydrophophic coatings, or polyester laminates. In another embodiment, dome wall 208 can include multiple layers of dielectric materials which include magnetic particles. For reasons to be detailed later, multiple layers including one or more magnetic layers can sometimes minimize losses experienced across multiple angles of incidence.

Figure 3:
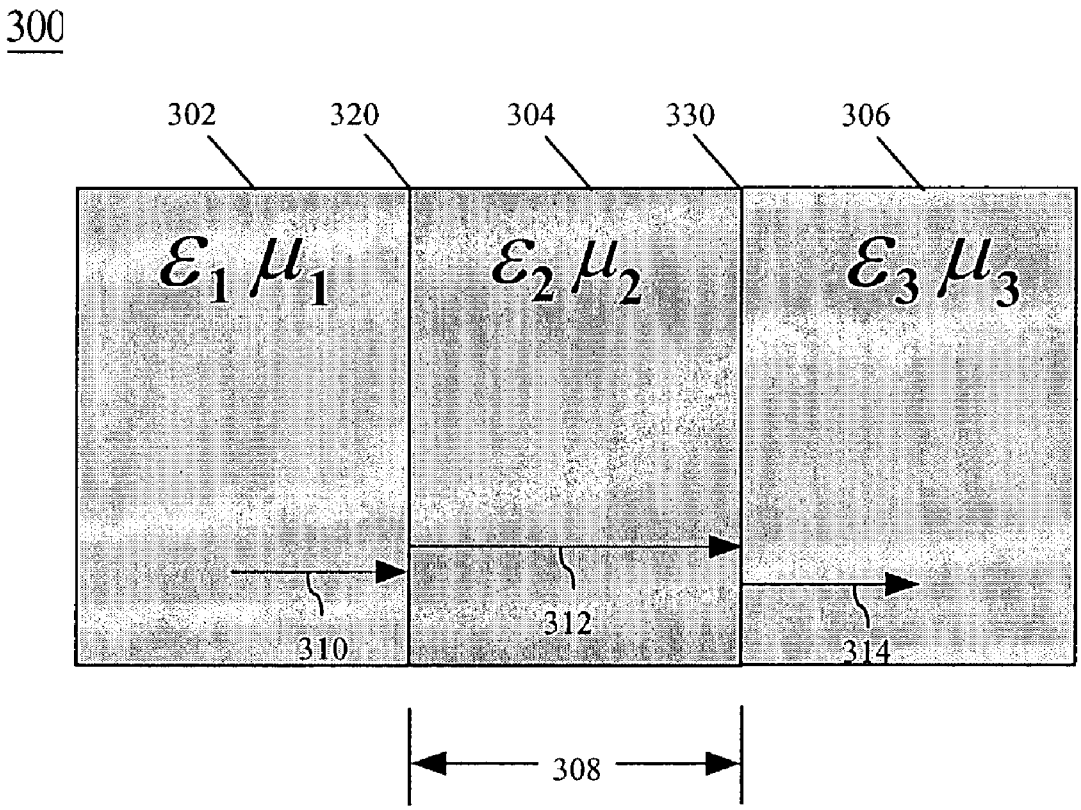
FIG. 3 is a schematic diagram illustrating an electromagnetic wave at normal incidence passing though a dome wall of a magnetic radome, according to an embodiment of the invention.

FIG. 3 is a schematic diagram illustrating a system 300 including a wave at normal incidence passing across two boundaries separating 3 mediums. System 300 can include medium 302, medium 304 of length 308, medium 306, and dielectric boundaries 320 and 330. Medium 302, medium 304, and medium 306 can have relative permittivity values;, $\in_1$, $\in_2$, and $\in_3$ and relative permeability values of $\mu_1$, $\mu_2$, and $\mu_3$ respectively. The incident wave is shown as 310 in medium 302, 312 in medium 304, and as 314 in medium 306.

Medium 304 can be a dielectric material including a plurality of magnetic particles. Accordingly, in FIG. 3, medium 304 can represent a wall of a radome. Similarly, mediums 302 and 306 can represent an environment in which a radome is placed. In one embodiment, medium 302 and medium 306 can both be air (with dielectric constant $\in_r$ and relative permeability $\mu_r$ nearly equal to 1). In another embodiment, medium 302 and medium 306 can both be a low loss dielectric foam. In yet another embodiment, medium 302 and medium 306 can be different mediums with unequal dielectric constant $\in_r$ and relative permeability $\mu_r$ values.

When equation $\mu 2 \cdot \in 1 = \mu 1 \cdot \in 2$ is satisfied, transmission at normal incidence can occur across boundary 320 without any significant reflection, since the intrinsic impedance is identical in mediums 302 and 304. Similarly, when equation $\mu 2 \cdot \in 3 = \mu 3 \cdot \in 2$ is satisfied, transmission at normal incidence can occur across boundary 330 without any significant reflection, since the intrinsic impedance is identical in mediums 304 and 306.

Notably, when medium 302 and medium 306 are equivalent mediums (i.e. both air), matching medium 304 to medium 302 will minimize losses across both boundary 320 and boundary 330.

However, when medium 302 and medium 306 are dissimilar and medium 304 is impedance matched to medium 302, medium 304 and 306 will not be impedance matched. In such a situation, a medium between medium 304 and medium 306 must be added so as to provide a quarter wave transformer. The length of such a medium is a quarter of a wavelength at the frequency of operation.

In most situations, mediums 302 and 306 will be equivalent mediums (e.g. air). Accordingly, length 308 of medium 304 will not affect transmission loss over a broad range of frequencies, provided that the relative permittivities and the relative permeabilities are nearly equal over these groups of frequencies. Therefore, the only measurable frequency dependence of medium 304 results from the variability of the dielectric constant with respect to the relative magnetic permeability over frequency. It is desired that this variability be small in most cases so that medium 304 can provide broadband performance. It should be noted that while length 308 of medium 304 has no effect for an ideal lossless medium 304, real-world dielectric mediums always exhibit some loss in the form of an electric loss tangent and a magnetic loss tangent. Hence, a dome wall should generally be made as thin as possible in order to minimize transmission loss.

The invention can also be extended to the impedance matching of radome frames to the air medium. Constructing a frame from a dielectric material with magnetic particles in accordance with the formula $\mu 2 \cdot \in 1 = \mu 1 \cdot \in 2$ can result in a frame with significantly less loss. Moreover, applying the invention to a frame can minimize the electromagnetic perturbations caused by conventional radome frames, which are called scatter loss.

The reductions in transmission losses resulting from a magnetic radome frame as disclosed herein over conventional radome frames can be substantial. Scatter loss occurring in conventional radomes can amount from 4 to 100 times a radome's wall pass losses. Notably, the effective width of a magnetic radome utilizing a magnetic frame and magnetic dome walls would be equal to the sum of the wall width and frame width at a frame/wall junction. Since the medium width does not affect the transmission loss (assuming nearly lossless mediums with very small electric and magnetic loss tangents) as detailed above, overall losses across the air/wall-frame boundary can be very low.

Mathematical calculations were performed to yield formulas that can be used to determine the values necessary for establishing an intrinsic impedance match at boundary 320 shown in FIG. 3 shall now be detailed. The intrinsic impedance ($\eta$) for a given medium is defined as $\eta = (\mu/\in)^{1/2}$ so the intrinsic impedance for medium 302 is $\eta_1 = (\mu_1/\in_1)^{1/2}$ and the intrinsic impedance for medium 304 is $\eta_2 = (\mu_2/\in_2)^{1/2}$. Next, the reflection coefficient ($\Gamma$) for a plane wave 310 normal to boundary 320 is defined as $\Gamma = (\eta_2 - \eta_1)/(\eta_2 + \eta_1)$. All energy is transmitted across the boundary 320 if the reflection coefficient is zero, that is $\Gamma = (\eta_2 - \eta_1)/(\eta_2 + \eta_1) = 0$.

Using the above formulas, the following calculations can be made:

$$(\eta_2 - \eta_1)/(\eta_2 + \eta_1) = 0 \quad (1)$$

$$(\eta_2 - \eta_1) = 0 \quad (2)$$

$$\eta_2 = \eta_1 \quad (3)$$

$$(\mu_2/\in_2)^{1/2} = (\mu_1/\in_1)^{1/2} \quad (4)$$

$$(\mu_2/\in_2) = (\mu_1/\in_1) \quad (5)$$

$$\mu_2 \in_1 = \mu_1 \in_2 \quad (6)$$

Equation (1) sets the reflection coefficient equation at the boundary 320 to zero. Equation (2) results from multiplying both sides of equation (1) by $(\eta_2 + \eta_1)$. Equation (3) results from adding $\eta_1$ to both sides of equation (2). Equation (4) results from substituting in the defined values for $\eta_2$ and $\eta_1$ into equation (3). Squaring both sides of equation (4) results in equation (5). Equation (6) results from multiplying both sides of equation (5) by $(\in_1 \cdot \in_2)$ Accordingly, when equation (6) is satisfied, an intrinsic impedance match between medium 302 and medium 304 occurs so that there is ideally no reflection loss for wave 310 normally incident at boundary 320.

Figure 4:
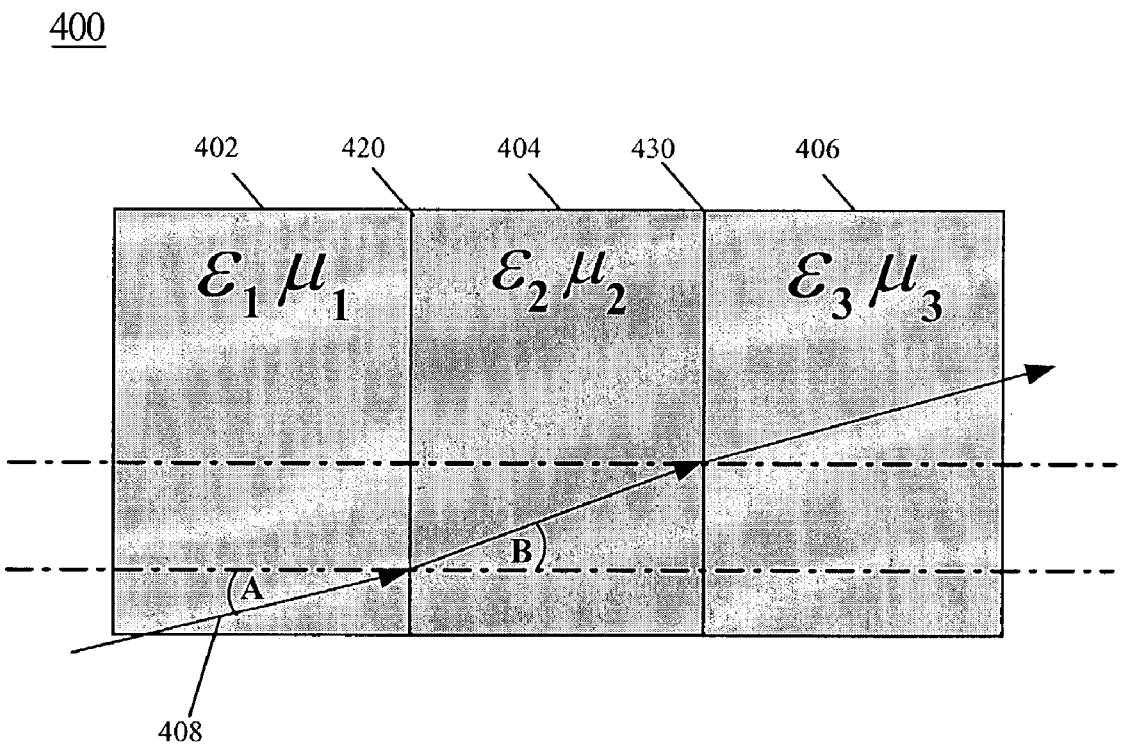
FIG. 4 is a schematic diagram illustrating an electromagnetic wave passing though a dome wall of a magnetic radome at a non-normal incident angle A, according to an embodiment of the invention.

FIG. 4 is a schematic diagram illustrating a system 400 including a wave at an angle of incidence different from normal incidence passing across two boundaries separating three mediums. System 400 can include medium 402, medium 404, medium 406, and boundaries 420 and 430. Medium 402, medium 404, and medium 406 can have relative permittivity values $\in_1$, $\in_2$, and $\in_3$ and relative permeability values of $\mu_1$, $\mu_2$, and $\mu_3$ respectively. An electromagnetic wave 408 is shown propagating in system 400 having an angle of incidence A and an angle of transmission B at boundary 420.

In one embodiment, medium 404 can be a single layered radome wall and mediums 402 and 406 can be substantially equivalent mediums representing the environment (air). In such an instance, the equations for determining complete transmission of wave 408 at a given angle of incidence A across the boundary 420 are $$(\mu_1/\in_1)^{1/2}*\cos B=(\mu_2/\in_2)^{1/2}*\cos A \quad (1)$$

for perpendicular polarization and $$(\mu_1/\in_1)^{1/2}*\cos A=(\mu_2/\in_2)^{1/2}*\cos B \quad (2)$$

for parallel-polarization, where A is the wave incident angle and B is the wave transmitted angle, $\in_1$ and $\mu_1$ are the relative permittivity and the relative permeability values for medium 402, and $\in_2$ and $\mu_2$ are the relative permittivity and the relative permeability for medium 404. The derivation of equation (1) and (2) will be detailed later.

Operationally, equations (1) and (2) can be used to calculate an optimized $\mu_2$ for a given angle of incidence A. For example, suppose that a plane wave is perpendicularly polarized and the angle of incidence is 30°. Assume the environment surrounding the radome is air. Also, let $\in_2=2$. Furthermore, assume that because of the placement of an antenna relative to the radome that the desired angle of transmission, Angle B, is 12.83°.

Hence, Angle A=30°, Angle B=12.83°, $\mu_1=1$, $\in_1=1$ and $\in_2=2$. Solving equation (1) for $\mu_2$ results in:

$$\mu 2=(\mu 1\cdot\in 2)/\in 1\cdot(\cos B/\cos A)2=(1\cdot 2)/1\cdot(\cos 12.83°/\cos 30°)2\mu 2=2.535.$$

The calculated relative permeability value of 2.535 is subject to rounding error. One of ordinary skill in the art should appreciate that by adjusting the selection and placement of a plurality of magnetic particles within a dome wall the relative magnetic permeability of the dome wall can be adjusted.

Mathematical derivations were conducted yielding formulas that can be used to calculate the values necessary for establishing an intrinsic impedance match at the boundary 420 for the electromagnetic wave 408, which shall now be detailed. The intrinsic impedance ($\eta$) for a given medium is defined as $\eta=(\mu/\in)^{1/2}$, so the intrinsic impedance for medium 402 is $\eta_1=(\mu_1/\in_1)^{1/2}$ and the intrinsic impedance for medium 404 is $\eta_2=(\mu_2/\in_2)^{1/2}$. Next, the reflection coefficient($\Gamma$) for a perpendicularly polarized wave 408 striking the boundary 420 with an angle of incidence A and an angle of transmission B is defined as $\Gamma_{perp}=(\eta_2*\cos A-\eta_1 \cos B)/(\eta_2*\cos A+\eta_1*\cos B)*\rho_{perp}$ where $\rho_{perp}$ is a phase factor. Additionally, for parallel polarization $\Gamma_{par}=(\eta_2*\cos B-\eta_1 \cos A)/(\eta_2*\cos B+\eta_1*\cos A)*\rho_{par}$. All the energy is transmitted across the boundary 420 if the reflection coefficient is zero, that is $\Gamma_{perp}=0$ and $\Gamma_{par}=0$, hence, it follows that $\Gamma_{perp}=\Gamma_{par}=0$.

Using the above formulas, the following calculations can be made for $\Gamma_{perp}$:

$$(\eta_2*\cos A-\eta_1 \cos B)/(\eta_2*\cos A+\eta_1*\cos B)*\rho_{perp}=0 \quad (1)$$

$$(\eta_2*\cos A-\eta_1 \cos B)/(\eta_2*\cos A+\eta_1*\cos B)=0 \quad (2)$$

$$(\eta_2*\cos A-\eta_1 \cos B)=0 \quad (3)$$

$$\eta_2*\cos A=\eta_1 \cos B \quad (4)$$

$$(\mu_2/\in_2)^{1/2}*\cos A=(\mu_1/\in_1)^{1/2}*\cos B \quad (5)$$

Equation (1) sets the reflection coefficient equation for perpendicular polarization to zero. Equation (2) results from dividing both sides of equation (1) by the phase factor, $\rho_{perp}$. Equation (3) results from multiplying both sides of equation (2) by ($\eta_2$*cos A+$\eta_1$*cos B). Equation (4) results from adding $\eta_1$ cos B to both sides of equation (3). Finally, equation (5) results from substituting in the defined values for $\eta_2$ and $\eta_1$ into equation (4).

One can similarly derive, from $\Gamma_{par}$ the equation $(\mu^1/\in_1)^{1/2}*\cos A=(\mu_2/\in_2)^{1/2}*\cos B$ for a parallel polarized wave 408. The near lossless transmission across a magnetic radome can be generally obtained only for a range of angles about a selected angle of incidence. The loss, modeled with the phase factor, increases as the angle of incidence deviates from the angle optimized for low loss performance. This range of angles at which the radome loss is very small can be increased using multiple layers walls within a radome.

In one embodiment, a radome wall can be formed from a plurality of layers where at least one of the layers is not intrinsically impedance matched to the others. When a multilayered radome wall contains layers not intrinsically impedance matched some reflection can occur at the boundaries between wall layers. Losses resulting from the imperfect intrinsic impedance matching can be offset by the corresponding loss reductions attributable to the phase factor. The phase factor is a complex quantity, which depends on the angle of incidence A, the angle of transmission B, the thickness of the radome layer, and a propagation factor of the medium. In turn, the propagation factor of the medium depends on the frequency, and the frequency domain complex permittivity and complex permeability. The frequency domain permittivity is complex when the electric loss tangent is non-zero. The frequency domain permeability is complex when the magnetic loss tangent is non-zero. The permittivity and the permeability quantities are real when used in a time domain analysis, and complex, when used in a frequency domain analysis. An optimal tradeoff resulting in minimal loss at a given non-optimal angle of incidence can be mathematically calculated using formulas $\Gamma_{perp}=(\eta_2*\cos A-\eta_1\cos B)/(\eta_2*\cos A+\eta_1\cos B)*\rho_{perp}$ and $\Gamma par=(\eta_2*\cos B-\eta_1*\cos A)/(\eta_2*\cos B+\eta_1\cos A)*\rho_{par}$. Accordingly, multilayered radomes can reduce the overall losses attributable to differing angles of incidences.

Figure 5:
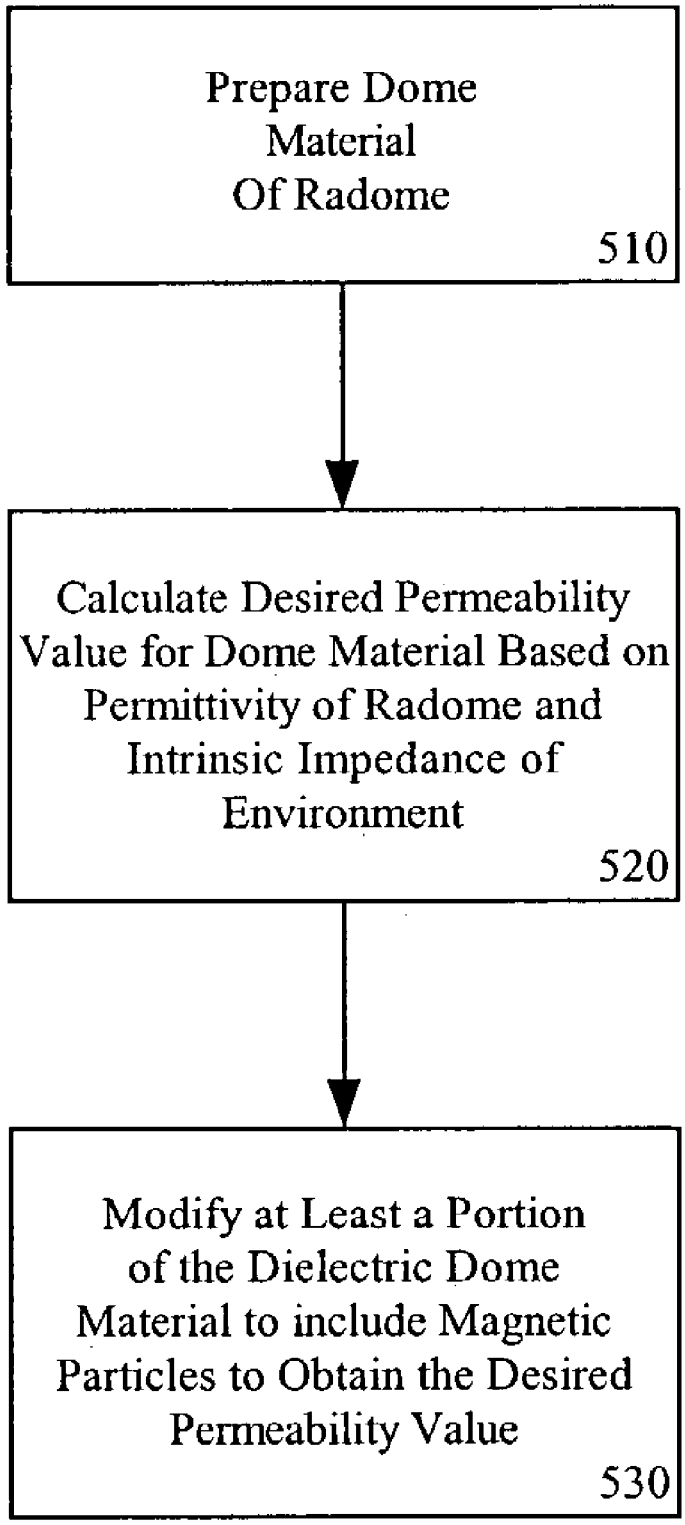
FIG. 5 is a flow chart that is useful for illustrating a process for constructing a magnetic radome.

FIG. 5 is a flow chart that is useful for illustrating a process for manufacturing a magnetic radome. In step 510, the dielectric dome wall material can be prepared. In step 520, a relative permeability value for the dome material is calculated based on the relative permittivity of the dome material and the intrinsic impedance of the environment for a given angle of incidence. In step 530, at least a portion of the dielectric wall material can be modified using metamaterials to obtain the calculated permeability value. The modification can include creating voids in a dielectric substrate material and filling some or substantially all of the voids with magnetic particles.

The process for preparing and modifying the dielectric dome wall material as described in steps 510 and 530 shall now be described in some detail. Notably, exemplary calculations occurring in step 520 have been described previously. It should be understood, however, that the methods described herein are merely examples and the-invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk of dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28-30 Ultra Low Fire COG dielectric formulation. These substrate materials can be used to provide dielectric layers having relatively low dielectric constants with accompanying relatively low electric loss tangents.

In the process of creating a radome wall using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some voids can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include metamaterials. The choice of a metamaterial composition can provide tunable effective dielectric constants over a relatively continuous range from less than 2 to about 2650. Tunable magnetic properties are also available from certain metamaterials. For example, through choice of suitable materials the relative effective magnetic permeability of the composite generally can range from about 2 to 116 for most practical RF applications. However, the relative effective magnetic permeability can be as low as 1 or reach into the thousands.

A given dielectric substrate may be differentially modified. The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions. For example, the modification can be a selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies, or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant. The dielectric material added as a supplemental layer can include various polymeric materials.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles. The selection of the particles is an important consideration in the minimization of the electric and magnetic loss tangents.

The particles, such as nanoparticles, can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8 GHz to 40 GHz. Alternatively, or in addition thereto, niobium organoceramics (NbCyHz)-(Ca/Sr/Ba-Ceramic) are useful for the frequency range of 12 GHz to 40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1% to 70%, it is possible to raise and possibly lower the dielectric constant of the dielectric substrate layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, may also be used.

The selectable dielectric properties can be localized to areas as small as about 10 nanometers, or cover large area regions, including an entire radome wall panel. Conventional techniques such as lithography and etching along with deposition processing can be used for localized dielectric and magnetic property manipulation.

Materials can be prepared mixed with other materials or including varying densities of voided regions (which generally introduce air) to produce effective relative dielectric constants in a substantially continuous range from 2 to about 2650, as well as other potentially desired substrate properties. For example, materials exhibiting a low dielectric constant (from less than 2 to about 4) include silica with varying densities of voided regions. Alumina with varying densities of voided regions can provide a relative dielectric constant from about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a relative dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a relative dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organofunctional materials, such as polytetrafluoroethylene (PTFE).

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas on the substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate portion.

Once formed, the stacked substrates can be optionally diced into cingulated pieces for testing purposes. During testing, the cingulated substrate pieces can be mounted to a test fixture for evaluation of their various characteristics, such as to assure that the dielectric, magnetic and/or electrical characteristics are within the specified limits.

Thus, dielectric substrate materials can be provided with localized tunable dielectric and magnetic characteristics for improving transmissions across magnetic radomes.

In many situations, thin radome walls can be advantageous. For instance, thin radome walls can reduce the loss. Additionally, thin radome walls can reduce sensitivity to the angle of incidence because the effects of the phase factor are reduced. When radome walls are thin, however, radome frames can be required to provide required mechanical support to the radome structure.

Thin radome walls in magnetic radomes can be defined in terms of wavelengths at the highest frequency of operation. For example, for a thin magnetic radome operating at 10 GHz, the corresponding free space wavelength is 3 cm. A very thin radome can have a thickness of about 1/100 of a wavelength or about 0.03 cm or smaller. Environmental conditions, radome size, performance requirements, and characteristics of a protected antenna can determine whether the walls of a magnetic radome should be made very thin.

When a radome utilizes a radome frame, scatter loss due to reflections from the frame structure can result. It can be beneficial in some applications to minimize this scattering. In these applications, an ideal radome frame is transparent to radio frequency waves. Scatter loss can also be minimized by designing the radome frame as if it were a second radome wall. Hence, the radome frame can be impedance matched in the same manner a radome wall can be impedance matched. Accordingly, in one embodiment, the radome frame can passively or actively adjust its electrical permittivity and magnetic permeability values to impedance match the surrounding mediums.

Figure 6A:
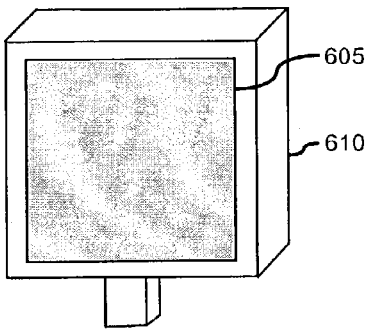
FIG. 6A is a schematic diagram of an exemplary magnetic radome including a radome frame.

FIG. 6A is a schematic diagram of an exemplary magnetic radome with a radome wall 605 and a radome frame 610. It should be noted that the exemplary radome shown in FIG. 6A can have a rectangular shape or other shape instead of having a hemispherical shape common in conventional radomes. Such a shape is possible due to the intrinsic impedance matching that occurs by adjusting the magnetic permeability and electrical permeability of the radome wall 605 and radome frame 610 with free space. This impedance matching is not substantially dependant upon the thickness of a radome wall or radome frame.

In contrast, conventional radomes perform impedance matching using a fractional wavelength (typically multiples of half of a wavelength) of transmitted waves. Conventional radome shapes are a result of this fractional wavelength impedance matching.

A magnetic radome can be shaped in any fashion and still be impedance matched. For example, in one embodiment, a magnetic radome can be shaped identically to a conventional radome. In fact, a conventional shape can be highly beneficial when a magnetic radome has multiple layered radome walls or utilizes traditional impedance matching techniques in combination with inventive techniques.

While the magnetic radome shown in FIG. 6A contains only one face with a thin radome wall 605, the invention is not so limited. For example, each face of the radome can contain a thin wall with the outer edges of the wall being supported by a thicker radome frame 610. As earlier stated, such design decision depends on the usage of the radome, environmental conditions, and operational requirements.

Figure 6B:
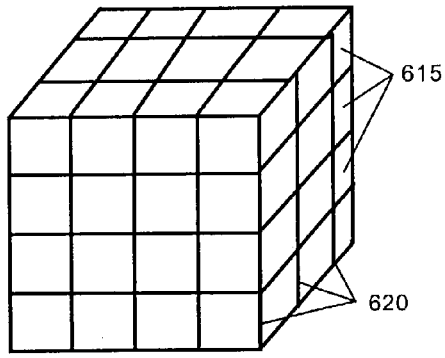
FIG. 6B is another schematic diagram of an exemplary magnetic radome including a radome frame.

FIG. 6B is a schematic diagram of another exemplary magnetic radome. The radome shown in FIG. 6B emphasizes that magnetic radomes can be formed in non-conventional shapes. As shown, the magnetic radome can include a radome wall 615 formed of many panels, each panel supported by a radome frame 620. The shape shown in FIG. 6B can be possible due to the intrinsic impedance matching that can occur by adjusting the magnetic permeability and electrical permittivity of the radome wall 605 and radome frame 610 with free space.

Figure 7B:
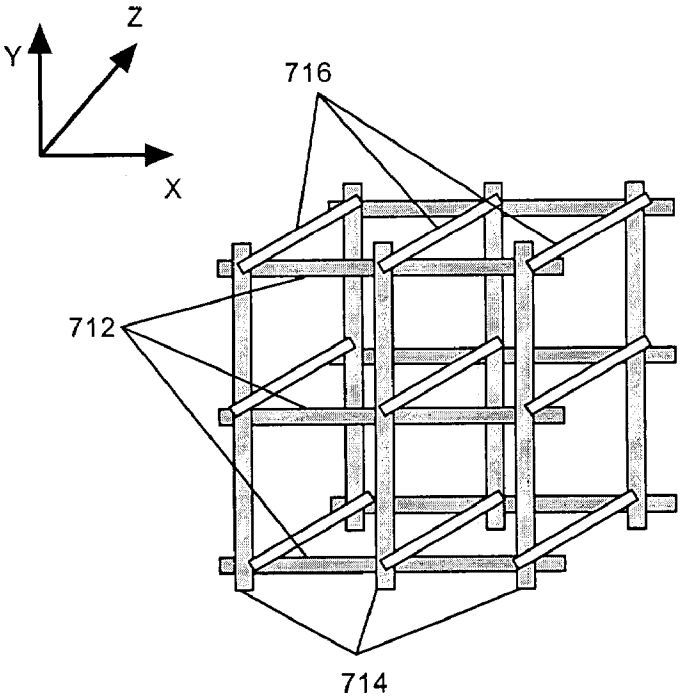
FIG. 7B is a schematic diagram of a passive composite material that can be polarization sensitive in the x, y, and z directions.
Figure 7A:
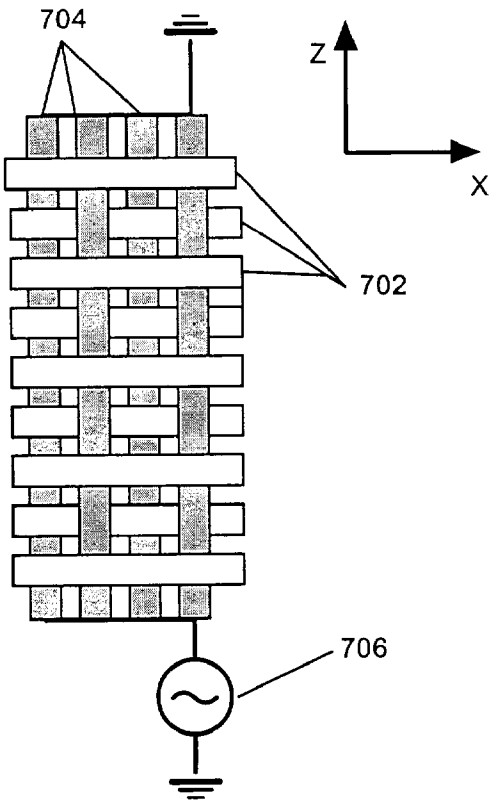
FIG. 7A is a schematic diagram of an active composite material that can be controlled in the x and y directions.

FIG. 7A and FIG. 7B are schematic diagrams of a system 700 showing exemplary polarization sensitive radomes. When the x, y, and z components of the relative permittivity and relative permeability are adjusted, the polarization of this radome can be controlled. This control permits the intrinsic impedance to be anisotropic. Accordingly, while the actual phase cannot be independently controlled for each polarization component, the polarization magnitude of each electric and magnetic field component can be independently controlled. However, as the magnitude changes, an associated phase shift will take place.

Polarization control has a mathematical basis. To establish this basis, Maxwell's equations, written in the Cartesian coordinate system neglecting electric and magnet loss tangents, and assuming a time harmonic solution for electric and magnetic fields, can be examined. These equations are:

$$H_x=j/(\omega\mu_{xx})(\partial E_z/\partial y-\partial E_y/\partial z),\qquad H_y=j/(\partial\omega\mu_{yy})(\partial E_x/\partial z-\partial E_z/\partial x),$$

$$H_z=j/(\omega\mu_{zz})(\partial E_y/\partial x-\partial E_x/\partial y),$$

$E_x=j/(\omega\in_{xx})(\partial H_z/\partial y-\partial H_y/\partial z)$, $E_y=(j/\omega\in_{yy})(\partial H_x/\partial z-\partial H_z/\partial z)$, and $E_z=j/(\omega\in_{zz})(\partial H_y/\partial x-\partial H_x/\partial y)$.

The equations can be interpreted to signify that the permittivity components $\in_{xx}$, $\in_{yy}$, and $\in_{zz}$ determine the values of the $\in_x$, $\in_y$, and $\in_z$ electric fields. Similarly, the permeability components $\mu_{xx}$, $\mu_{yy}$, and $\mu_{zz}$ can determine the $H_x$, $H_y$, and $H_z$ magnetic fields. The equations also suggest that intrinsic impedances can be different in the x, y, and z directions.

Using the above equations to solve for an electric field magnitude and a magnetic field magnitude for a perpendicularly polarized wave can yield the following equations:

$$\overline{E}_{perp}^{t}(x,y,z,;t)=\hat{y}T_y^{perp}E_0e^{-(\gamma_{2x}(\omega)\cdot x\cdot\sin\theta_t+\gamma_{2z}(\omega)\cdot z\cdot\cos\theta_t)}e^{j\omega t} \text{ and}$$

$$\overline{H}_{perp}^{t}(x,y,z;t)=\left(-\hat{x}\cos\theta_t\frac{T_x^{perp}}{\eta_{2x}}+\hat{z}\sin\theta_t\frac{T_z^{perp}}{\eta_{2z}}\right)E_0e^{-(\gamma_{2x}(\omega)\cdot x\cdot\sin\theta_t+\gamma_{2z}(\omega)\cdot z\cdot\cos\theta_t)}e^{j\omega t}$$

where $\gamma_{2x}(\omega)=j\omega\sqrt{\mu_{2x}\cdot\in_{2x}}$, and $\gamma_{2x}(\omega)=j\omega\sqrt{\mu_{2z}}$.

Using the same equations to solve for a parallel polarized wave can yield the following equations:

$$\overline{E}_{//}^{t}(x,y,z;t)=(\hat{x}\cos\theta_tT_x^{//}-\hat{z}\sin\theta_tT_z^{//})E_0e^{-(\gamma_{2x}(\omega)\cdot x\cdot\sin\theta_t+\gamma_{2z}(\omega)\cdot z\cdot\cos\theta_t)}e^{j\omega t} \text{ and}$$

$$\overline{H}_{//}^{t}(x,y,z;t)=\hat{y}\frac{T_y^{//}E_0}{\eta_{2y}}e^{-(\gamma_{2x}(\omega)\cdot x\cdot\sin\theta_t+\gamma_{2z}(\omega)\cdot z\cdot\cos\theta_t)}e^{j\omega t}.$$

This result suggests that the electric and magnetic field phases depend on the permittivity and the permeability in the x and z directions. Furthermore, changing the permittivity in the y-direction and the permeability in the x and z directions can only affect the perpendicular polarization magnitude. Similarly, changing the permittivity in the x and z directions and the permeability in the y directions can only affect the parallel polarization magnitude. Consequently, the perpendicular polarization magnitude can be controlled independently from the parallel polarization. This is possible because the perpendicular and parallel polarizations are orthogonal to each other. The phases of the perpendicular and the parallel polarizations will change with the adjustments made to the material properties; however, the phase cannot be independently controlled for each polarization.

In one embodiment, a single radome material capable of being controlled in the x, y, and z directions can be used in forming the wall of the radome. In another embodiment, composite materials can be specifically designed to control the intrinsic impedance in particular directions, such as the x, y, and z directions. These composite materials can be constructed to provide polarization selection in a passive and/or active fashion.

For example, composite fibers can be built with interleaved fibers directed along particular directions. These fibers can be interleaved in many different forms, two of which are shown in FIG. 7A and FIG. 7B, respectively. The suggested thickness for each of these fibers utilized within the dome wall is approximately one one-hundredth (0.01) of a wavelength.

FIG. 7A is a schematic diagram of an active composite material that can be controlled in the x and y directions. The composite material can be utilized within one or more layers of a radome. As shown in FIG. 7A, the composite material can include fibers 702 interleaved in the x direction and fibers 704 interleaved in the y direction. The composite material can also include a current/and or voltage source 706. Fibers 702 can change permittivity in the x-direction under an applied voltage provided by the voltage source 706. This voltage can be simultaneously applied to the fibers 702 or can be individually applied to selective ones of the fibers 702. Voltage sources 706 that utilized either direct or alternating current can be used by the system 700.

Furthermore, while an alternating voltage source 706 is depicted, any activation source capable of providing energetic stimulus to the fiber lattice can be used. For example, in one embodiment, the voltage source 706 can be directly replaced with a current source. Alternatively, a heat source can be utilized to energize fibers within the composite lattice where specified properties of the fibers can be temperature dependant. On the other hand, externally generated electric and magnetic fields with a specified field configuration, can adjust in a controlled way the properties of selected groups of fibers.

In operation, changing the intrinsic impedance of the fibers 702 can affect the x-component of a parallel polarized electric field and the transmission coefficient in the x direction. Similarly, changing the intrinsic impedance of the fibers 704 can affect the z-component of a parallel polarized electric field and the transmission coefficient in the z-direction. The electrical and magnetic field magnitudes for perpendicular polarization will not be significantly affected by manipulations targeting parallel polarized waves, as determinable using the aforementioned mathematical formulas.

FIG. 7B is a schematic diagram of a passive composite material that can provide polarization adjustability in the x, y, and z directions. The composite material shown can be utilized within one or more layers of a radome. As shown in FIG. 7B, the composite material can include fibers 712 interleaved in the x direction, fibers 714 interleaved in the y direction, and fibers 716 interleaved in the z direction. The fibers 712, 714, and 716 can be arranged in a cubical lattice where each lattice node is formed by three orthogonal components. Each directional grouping of fibers can be specifically designed with a predetermined dielectric constant and/or a relative permeability. Consequently, the lattice can be constructed to be sensitive to polarizations based upon the permeability and permittivity values of the fibers of which it is composed.

The lattice of composite fibers can be designed to conform to many different coordinate systems, such as the cylindrical and spherical coordinate systems. In each system, each unit vector associated with particular ones of the composite fibers can be orthogonal to each other. Additionally, composite fiber lattices can be constructed to be rigid or flexible depending on the application. It should also be noted that an electromagnetic coupling will occur among fibers causing the effective permittivity and permeability of a composite fiber lattice to be different from individual fiber permittivity or permeability values.

This invention can be embodied in other forms without departing from the spirit or essential attributes thereof. Figures and exemplary schematic diagrams have been included to aid in the understanding of the invention described herein. These illustrations are not intended to limit the invention to the illustrated forms. Accordingly, reference should be made to the following claims, rather than to the foregoing specification, as indicating the scope of the invention.

What is claimed is:

1. A radone, comprising:

a dome, wherein said dome comprises a dome wall, said dome wall formed from at least one dielectric material, wherein at least a portion of said dielectric material comprises at least one metamaterial that includes magnetic particles, and said metamaterial is comprised of a mixture of two or more different materials that are mixed at an Angstrom or nanometer level of particle size.

2. The radome of claim 1, wherein at least a portion of said dome wall has a relative magnetic permeability of at least 1.1.

3. The radome of claim 1, wherein said dome wall allows selective transmissIon of waves based on particular polarities, said selective transmissions determined by a selection and placement of at least a portion of said magnetic particles within said dielectric material.

4. The radome of claim 1, wherein $\mu_1$ is the relative magnetic permeability of said dielectric material and $\in_1$ is the relative electric permittivity of said dielectric material, wherein the selection of said dielectric material is determined by values of said $\mu_1$ and said $\in_1$, wherein said values of said $\mu_1$ and said $\in_1$ are determined by a concentration or placement of said magnetic particles within said dielectric material.

5. The radome of claim 4, wherein $\mu_2$ is the relative permeability of a medium extending from a boundary of said dome and $\in_2$ is the relative permittivity of said medium, wherein the selection of said dielectric material is based upon desired values of said $\mu_2$ and said $\in_2$, wherein said values of said $\mu_2$ and said $\in_2$ are determined by a concentration or placement of said magnetic particles within said dielectric material.

6. The radome of claim 5, wherein $\theta_i$ is the angle of incidence of a wave striking said boundary, wherein the selection of said dielectric material is based upon desired values of said $\theta_i$, wherein said values of said $\theta_i$ are determined by a concentration or placement of said magnetic particles within said dielectric material.

7. The radome of claim 6, wherein $\theta_t$ is the angle of transmission of said wave relative to said boundary, wherein the selection of said dielectric material is based upon desired values of said $\theta_t$, wherein said values of said $\theta_t$ are determined by a concentration or placement of said magnetic particles within said dielectric material.

8. The radome of claim 1, said at least one dielectric material comprises a first dielectric layer and at least one supplemental dielectric layer.

9. The radome of claim 8, wherein $\mu_3$ is the relative permeability of said first dielectric layer and $\in_3$ is the relative pennittivity of said first dielectric layer, $\mu_4$ is the relative permeability of said supplemental dielectric layer and $\in_4$ is the relative permittivity of said supplemental dielectric layer, wherein the selection of material for said first dielectric layer and said supplemental dielectric layer is based upon desired values of said $\in_3$, $\mu_3$, $\in_4$, and $\mu_4$.

10. A radome comprising:

a dome, wherein said dome comprises a dome wall, said dome wall formed from at least one dielectric material, wherein at least a portion of said dielectric material includes magnetic particles; and a radome frame, at least a portion of said radome frame formed from at least one frame dielectric material, wherein at least a portion of said frame dielectric material includes magnetic particles.

11. A radome, comprising:

a dome, wherein said dome comprises a dome wall, said dome wall formed from at least one dielectric material, wherein at least a portion of said dielectric material comprises at least one metamaterial that includes magnetic particles;

wherein at least a portion of said dome wall comprises a composite material including a plurality of fibers, wherein said plurality of fibers are interlaced to form a lattice, said lattice being configured to be polarization sensitive.

12. A radome, comprising:

a dome, wherein said dome comprises a dome wall, said dome wall formed from at least one dielectric material;

wherein:

at least a portion of said dielectric material includes magnetic particles;

$\mu_1$ is the relative magnetic permeability of said dielectric material and $\in_1$ is the relative electric permittivity of said dielectric material, the selection of said dielectric material is based upon desired values of said $\mu_1$ and said $\in_1$, and said values of said $\mu_1$ and said $\in_1$ are determined by a concentration or placement of said magnetic particles within said dielectric material;

$\mu_2$ is the relative permeability of a medium extending from a boundary of said dome and $\in_2$ is the relative permittivity of said medium, the selection of said dielectric material is based upon desired values of said $\mu_2$ and said $\in_2$, and said values of said $\mu_2$ and said $\in_2$ are determined by a concentration or placement of said magnetic particles within said dielectric material;

$\theta_i$ is the angle of incidence of a wave striking said boundary, the selection of said dielectric material is based upon desired values of said $\theta_i$, and said values of said $\theta_i$ are determined by a concentration or placement of said magnetic particles within said dielectric material;

$\theta_t$ is the angle of transmission of said wave relative to said boundary, the selection of said dielectric material is based upon desired values of said $\theta_t$, and said values of said $\theta_t$ are determined by a concentration or placement of said magnetic particles within said dielectric material;

said wave is a perpendicularly polarized plane wave;

$\mu_1$ is between $0.95*(\in_1*\mu_2/\in_2)*(\cos\theta_i/\cos\theta_t)^2$; and $1.05*(\in_1*\mu_2/\in_2)*(\cos\theta_i,\cos\theta_t)^2$.

13. A radome, comprising:

a dome, wherein said dome comprises a dome wall, said dome wall formed from at least one dielectric material;

wherein:

at least a portion of said dielectric material includes magnetic particles;

$\mu_1$ is the relative magnetic permeability of said dielectric material and $\in_1$ is the relative electric permittivity of said dielectric material, the selection of said dielectric material is based upon desired values of said $\mu_1$ and said $\in_1$, and said values of said $\mu_1$ and said $\in_1$ are determined by a concentration or placement of said magnetic particles within said dielectric material;

$\mu_2$ is the relative permeability of a medium extending from a boundary of said dome and $\in_2$ is the relative permittivity of said medium, the selection of said dielectric material is based upon desired values of said $\mu_2$ and said $\in_2$, and said values of said $\mu_2$ and said $\in_2$ are determined by a concentration or placement of said magnetic particles within said dielectric material;

$\theta_i$ is the angle of incidence of a wave striking said boundary, the selection of said dielectric material is based upon desired values of said $\theta_i$, and said values of said $\theta_i$ are determined by a concentration or placement of said magnetic particles within said dielectric material;

$\theta_t$ is the angle of transmission of said wave relative to said boundary, the selection of said dielectric material is based upon desired values of said $\theta_t$, and said values of said $\theta_t$ are determined by a concentration or placement of said magnetic particles within said dielectric material;

said wave is a parallel polarized plane wave;

$\mu_1$ is between $0.95*(\in_1*\mu_2,\in_2)*(\cos\theta_t/\cos\theta_i)^2$; and $1.05*(\in_1*\mu_2/\in_2)*(\cos\theta_t/\cos\theta_i)^2$.

14. A radome, comprising:

a dome comprising a dome wall, said dome wall formed from at least one dielectric material comprising a first dielectric layer and at least one supplemental dielectric layer;

wherein:

at least a portion of said dielectric material includes magnetic particles;

$\mu_3$ is the relative permeability of said first dielectric layer and $\in_3$ is the relative permittivity of said first dielectric layer, $\mu_4$ is the relative permeability of said supplemental dielectric layer and $\in_4$ is the relative permittivity of said supplemental dielectric layer, wherein the selection of material for said first dielectric layer and said supplemental dielectric layer is based upon desired values of said $\in_3$, $\mu_3$, $\in_4$, and $\mu_4$; and $\mu_3$ is between $0.95*(\in_3*\mu_4)\in_4)$ and $1.05*(\in_3*\mu_4/\in_4)$.

* * * * *

UNITED STATES PATENT AND TRADEMARK OFFICE

CERTIFICATE OF CORRECTION

PATENT NO. : 7,006,052 B2 
APPLICATION NO. : 10/439094
DATED : February 28, 2006
INVENTOR(S) : Delgado et al.

It is certified that error appears in the above-identified patent and that said Letters Patent is hereby corrected as shown below:

Column 3
Line 66, delete "$\theta^{i}$" and replace with -- $\theta_i$ --.

Column 5
Line 13, delete "lur" and replace with -- $\mu$ --.
Line 41, delete "or" amd replace with -- $\mu$ --.
Line 47, delete "pr" and replace with -- $\mu$ --.

Column 8
Line 11, delete "permeabilit" and replace with -- permeability --.

Column 10
Line 48, after "($\epsilon$ 1· $\epsilon$ 2)" insert -- . --.

Column 11
Line 9, after "parallel" delete "-".

Column 12
Line 5, delete "$\mu^{1}$" and replace with -- $\mu$1 --.
Line 56, after "the" delete "-".

Column 17
Line 16, delete "$\bar{E}_{perp}^{t}(x,y,z,;t)=\hat{y}T_y^{perp}E_{0e}^{-(\gamma 2x(\omega)\cdot x\cdot \sin\theta_t+\gamma 2z(\omega)\cdot z\cdot\cos\cdot\theta t)}e^{j\omega t}$" and replace with -- $\bar{E}^{t}_{perp}(x, y, z; t) = \hat{y}T_y^{perp}E_0 e^{-(\gamma_{2x}(\omega)\cdot x\cdot \sin\theta_1+\gamma_{2x}(\omega)\cdot z\cdot\cos\theta_1)}e^{j\omega t}$ --.

Line 25, delete "$\gamma_{2x}(\omega) = j\omega\sqrt{\mu_{2z}}$." and replace with $-\gamma_{2z}(\omega) = j\omega\sqrt{\mu_{2z}\cdot\epsilon_{2z}}$. --.

Line 30, delete "$\bar{E}_{//}^{t}$" and replace with -- $\bar{E}^{t}_{//}$ --.

Column 19
Claim 9, line 55, delete "pennittivity" and replace with -- permittivity --.

Column 21
Claim 13, line 17, delete "($\epsilon_1$ *$\mu_2$,$\epsilon_2$)" and replace with -- ($\epsilon_1$ *$\mu_2$ / $\epsilon_2$) --.

UNITED STATES PATENT AND TRADEMARK OFFICE

CERTIFICATE OF CORRECTION

PATENT NO. : 7,006,052 B2
APPLICATION NO. : 10/439094
DATED : February 28, 2006
INVENTOR(S) : Delgado et al.

It is certified that error appears in the above-identified patent and that said Letters Patent is hereby corrected as shown below:

Column 22
Claim 14, line 17, delete "$0.95*(\epsilon_3 *\mu_4)\epsilon_4)$" and replace with -- $0.95*(\epsilon_3 *\mu_4)/ \epsilon_4)$ --.

Signed and Sealed this

Twenty-sixth Day of February, 2008

JON W. DUDAS
*Director of the United States Patent and Trademark Office*